United States Patent [19]

Ono

[11] Patent Number: 4,920,040

[45] Date of Patent: Apr. 24, 1990

[54] SILVER HALIDE PHOTOGRAPHIC LIGHT-SENSITIVE MATERIAL FOR A LASER LIGHT EXPOSURE

[75] Inventor: Kouzi Ono, Tokyo, Japan

[73] Assignee: Konica Corporation, Tokyo, Japan

[21] Appl. No.: 278,318

[22] Filed: Dec. 1, 1988

[30] Foreign Application Priority Data

Dec. 3, 1987 [JP] Japan ..... 62-307208

[51] Int. Cl.[5] ..... G03C 7/00; G03C 5/24; G03C 1/02

[52] U.S. Cl. ..... 430/363; 430/444; 430/578; 430/599; 430/608; 430/627; 430/945

[58] Field of Search ..... 430/945, 578, 608, 599, 430/627, 363, 444

[56] References Cited

U.S. PATENT DOCUMENTS 4,212,672 7/1980 Mihara et al. ..... 430/945

FOREIGN PATENT DOCUMENTS 62-85240 4/1987 Japan ..... 430/627

*Primary Examiner*—Paul R. Michl
*Assistant Examiner*—Thomas R. Neville
*Attorney, Agent, or Firm*—Finnegan, Henderson, Farabow, Garrett and Dunner

[57] ABSTRACT

A silver halide light-sensitive photographic material for a laser light exposure is disclosed. The material comprises a support having thereon at least one light-sensitive silver halide emulsion layer containing silver halide grains therein and a layer adjacent thereto, wherein said silver halide grains are spectrally sensitized with a dye represented by the following formula I, at least one layer of said silver halide emulsion layer and said adjacent layer contains a fluorine-containing ionic surfactant, a non-ionic surfactant and an inorganic salt;

formula I

The material of the invention excels in each of sensitivity, gradation and maximum density, and exhibits good coloration.

10 Claims, No Drawings

SILVER HALIDE PHOTOGRAPHIC LIGHT-SENSITIVE MATERIAL FOR A LASER LIGHT EXPOSURE

FIELD OF THE INVENTION

The present invention relates to a silver halide photographic light-sensitive material for a laser light exposure, wherein the silver halide photographic light-sensitive material is characterized by less conspicuous scanning-induced density irregularities, sufficient maximum density, pure black tone (cold tone) of a resultant reproduced image, and the light-sensitive material is capable of providing a high quality recorded image, and free from loss in sensitivity, and excels in red-sensitivity, and has improved resistance against fluctuation in photographic performance that is otherwise affected by developing conditions.

BACKGROUND OF THE INVENTION

There is an effort to capture digitized values based on a radiograph for medical diagnosis, and to subject the values to imaging process for generating an image that is more suitable for diagnosis, and to reproduce the image by exposing using a laser beam.

With a scanning technique, where main scanning is based on a laser beam, and sub-scanning is based on mechanical shifting means, accuracy of scanning speed both in main- and sub-scanning directions is limited, and this limitation results in density irregularities, i.e. scanning-induced density irregularities, once a silver halide photographic light-sensitive material is processed to obtain an image, thereby the resultant image may be jeopardized and may lead to a wrong diagnosis.

One method to solve such a problem is to make contrast $\gamma = 1.0$ to 2.5, preferably, 1.7 to 2.2, relative to a range 1.0 to 2.0 of the transmittance density D $$\left( D = \log \frac{\text{entrance light amount)}}{\text{transmitted light amount}} \right)$$

of the above-mentioned silver halide light-sensitive hotographic material undergone developing. This method is capable of making scanning induced density irregularities less visible. Accordingly, a silver halide light-sensitive photographic material satisfying relevant conditions incorporates, for example, a silver halide emulsion whose average grain size being 0.1 to 0.7 μm.

However, developing a light-sensitive material containing silver halide grains of the average size above may turn the tone of developed silver yellower, and the possible reason of which is that around a silver image occur ultra-fine colloidal silver grains that have failed to satisfactorily grow into silver filaments, thereby the silver image appears yellowish due to light diffused by these silver grains.

For tone improvement on a silver image, studies were performed with various tone improving agents, and one effective such an agent is a mercapto compound. A mercapto compound, for example, 1-phenyl-5-mercaptotetrazole is known to be effective in improving tone. However, using a large amount of such a compound in order to sufficiently improving tone results in loss in both maximum density and sensitivity (Japanese Patent Publication Open to Public Inspection, hereinafter referred to as Japanese Patent O.P.I. Publication, Nos. 111846/1981 and 71047/1984).

In order to reduce density irregularities mentioned above, lowering gradation of a light-sensitive material is a usual practice. However, excessively low gradation makes it impossible to provide sufficient exposure of a laser beam, thereby a low density image can only be obtained, may result in inhibiting diagnosis.

The light-sensitive material of the invention is exposed using a laser beam. For this purpose, a He-Ne laser is particularly advantageous because of stableness in performance, durability and the like. A latent image generated by exposing in a short duration with highly intense laser beam is readily affected by change in developing conditions such as a processing temperature, time, and stirring conditions, and may cause density irregularities in photographic processing.

SUMMARY OF THE INVENTION

One object of the invention is to provide a light-sensitive material for a laser light exposure, wherein the material is less prone to exhibit scanning-induced density irregularities and has sufficient maximum density. Another object of the invention is to provide a light-sensitive material for a laser light exposure, wherein the material is capable of rendering a tone of a reproduced image to be pure black (cold black tone) and of providing a high quality silver image, and is free from lowering in sensitivity. Still another object of the invention is to provide a light-sensitive material for a laser light exposure, wherein the material excels in red-sensitivity, and fluctuation, due to change in developing conditions, in photographic characteristics is improved.

The above-mentioned objects of the invention are achieved by a silver halide light-sensitive photographic material for a laser light exposure comprising a support having thereon at least one light-sensitive silver halide emulsion layer containing silver halide grains therein and a layer adjacent thereto, wherein said silver halide grains are spectrally sensitized with a dye represented by the following Formula 1, and at least one layer of said silver halide emulsion layer and said adjacent layer contains a fluorine-containing ionic surfactant, a nonionic surfactant and an inorganic salt;

Formula I

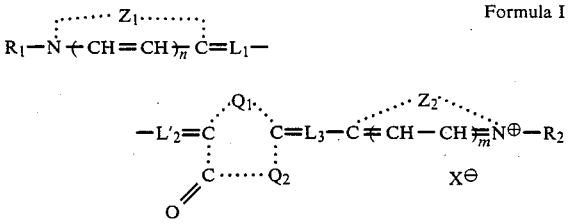

wherein $Z_1$ and $Z_2$ independently represent an atomic group needed for completing a five- or six-membered nitrogen-containing heterocycle;

$R_1$ and $R_2$ independently represent a saturated or unsaturated aliphatic group;

$Q_1$ and $Q_2$ independently represent an atomic group needed for completing a 4-thiazolidinone, a 4-oxazolidinone, a 4-imidazolidinone, a 5-thiazolidinone, a 5-oxazolidinone or a 5-imidazolidinone ring;

$L_1$, $L_2$ and $L_3$, indenpendently represent a methin group or a substituted methin group

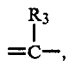

wherein $R_3$ represents a methyl group, an ethy group, an ethoxy group or an aryl group.)

X represents an inorganic or organic acid anion;

m and n independently represent an integer of 0 to 3.

DETAILED DESCRIPTION OF THE INVENTION

The sensitizing dyes represented by Formula I of the invention are hereunder described in detail.

In Formula I, $Z_1$ and $Z_2$ independently represent an atomic group needed for completing a five- or six-membered nitrogen containing heterocycle. The examples of such a heterocycle include a thiazole ring, a benzothiazole ring, a naphthothiazole ring, a selenazole O ring, a benzoselenazole ring, a naphthoselenazole ring, an oxazole ring, a benzoaxazole ring, a naphthoxazole ring, a imidazole ring, a benzimidazole ring, or a quinoline ring. The examples of a substituent possibly on such a heterocycle include halogen atoms such as a chlorine atom, and bromine atom; alkyl groups having 1 to 4 carbon atoms, such as methyl, ethyl, n-propyl, n-butyl, and t-butyl groups; alkoxy groups having 1 to 4 carbon atoms, such as methoxy, ethoxy, n-propyloxy.

$R_1$ and $R_2$ independently represent a saturated or unsaturated aliphatic group, and examples of which include methyl, ethyl, 2-hydroxyethyl, 2-methoxyethyl, 2-acetoxyethyl, carboxymethyl, 3-carboxypropyl, 2-carboxyethyl, 4-carboxybutyl, 2-sulfoethyl, 3-sulfopropyl, 3-sulfobutyl, 4-sulfobutyl, vinylmethyl, benzyl, phenethyl, p-sulfophenethyl, n-propyl, isopropyl, n-butyl, phenylethyl, and p-sulfophenylethyl groups.

$Q_1$ and $Q_2$ (combination) represent an atomic group needed for completing a 4-thiazolidinone, a 5-thiazolidinone, a 4-imidazolidinone, a 5-oxazolidinone, a 4-oxazolidinone, or a 5-imidazolidinone ring.

The examples of a substituent possibly present on the above-mentioned thiazolidinone ring, imidazolidinone ring, or oxazolidinone ring include alkyl groups having 1 to 4 carbon atoms, such as methyl, ethyl, 2-hydroxyethyl, 2-methoxyethyl, 2-acetoxyethyl, carboxymethyl, 2-carboxyethyl, propyl, isopropyl, benzyl, and phenylethyl groups; aryl groups such as phenyl, 2-carboxyphenyl, and p-sulfophenyl groups.

$L_1$, $L_2$, and $L_3$ independently represent a methine group or substituted methine group

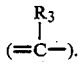

$R_3$ represents a methyl group, an ethyl group, an ethoxy group or an aryl group such as phenyl, p-chlorophenyl, and p-methylphenyl groups which are substituted or unsubstituted.

X represents an inorganic or organic acid anion such as a chlorine ion, bromine ion, iodine ion, perchloric acid, benzene sulfonate, p-toluene sulfonate, methyl sulfate, and ethylsulfate.

The typical dyes represented by Formula I are as follows:

I-1

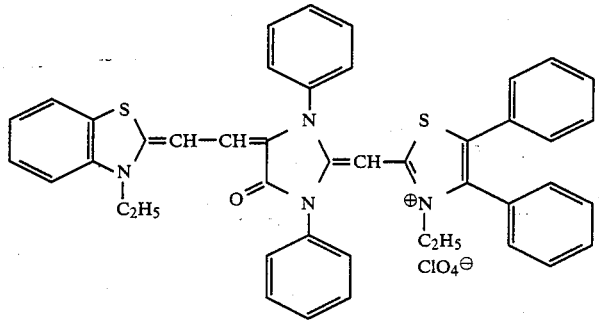

MeOH
λ max 604 nm

I-2

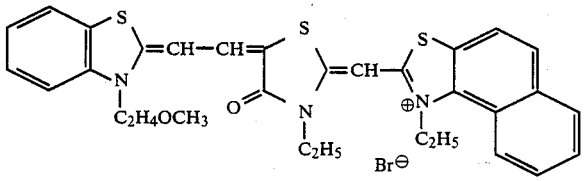

MeOH
λ max 584 nm

I-3

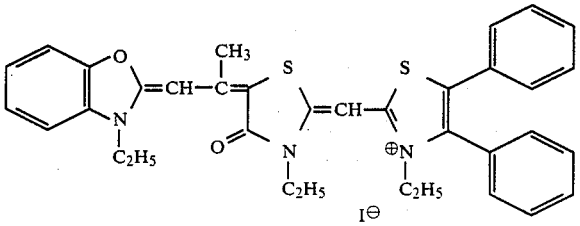

MeOH
λ max 570 nm

-continued
I-4
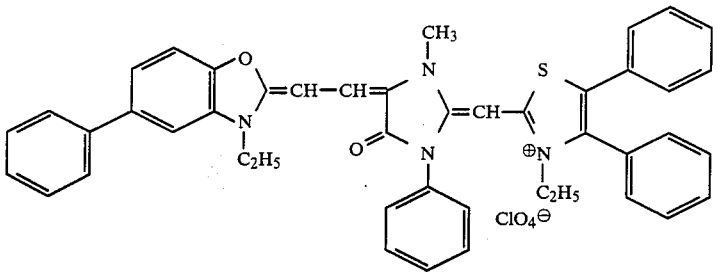
MeOH
λ max 572 nm
I-5
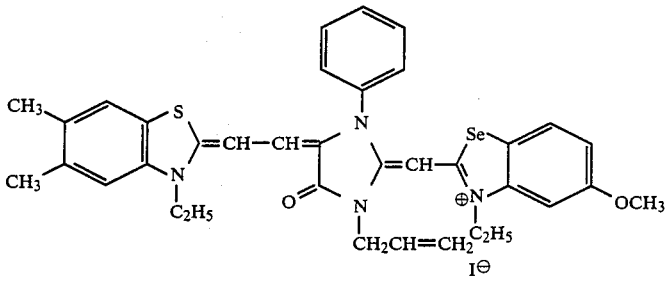
MeOH
λ max 595 nm
I-6
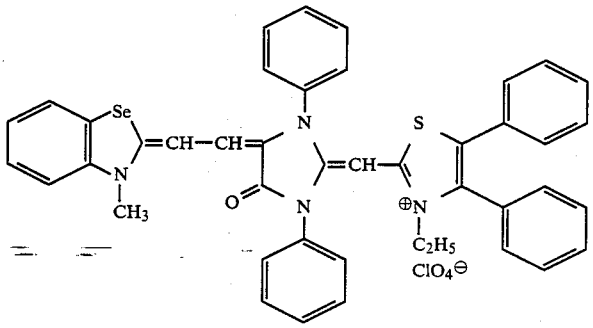
MeOH
λ max 603 nm
I-7
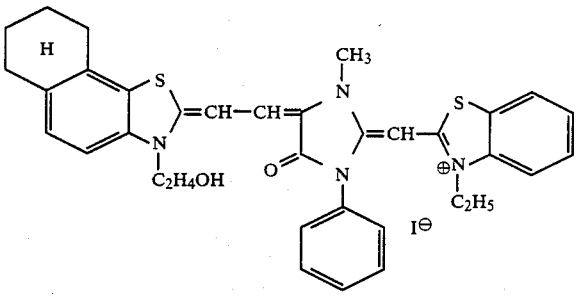
MeOH
λ max 600 nm
I-8
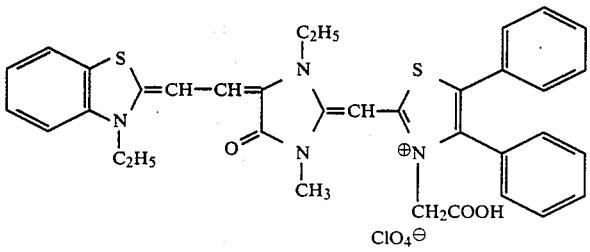
MeOH
λ max 598 nm -continued
I-9
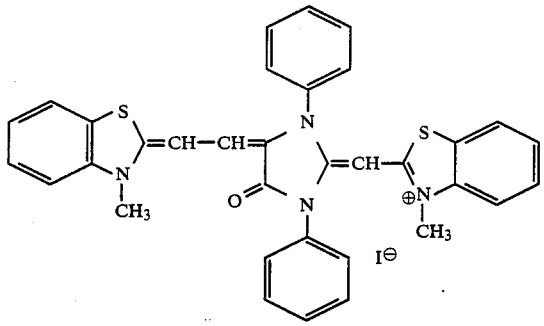
MeOH
λ max 595 nm
I-10
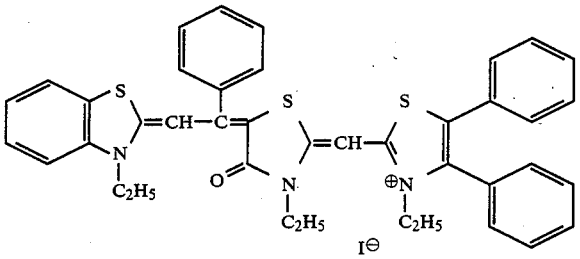
MeOH
λ max 593 nm
I-11
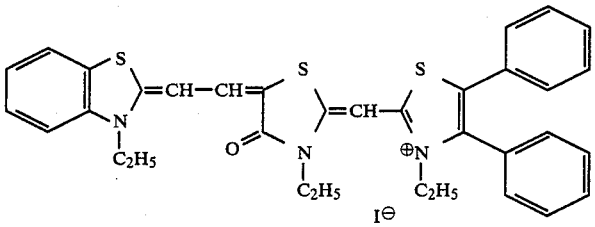
MeOH
λ max 588 nm
I-12
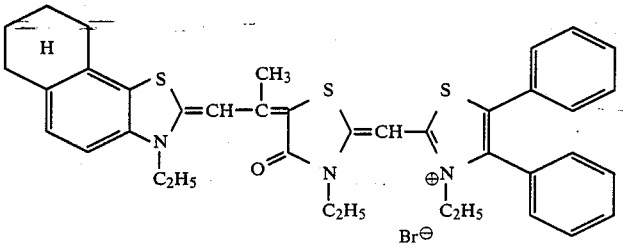
MeOH
λ max 595 nm
I-13
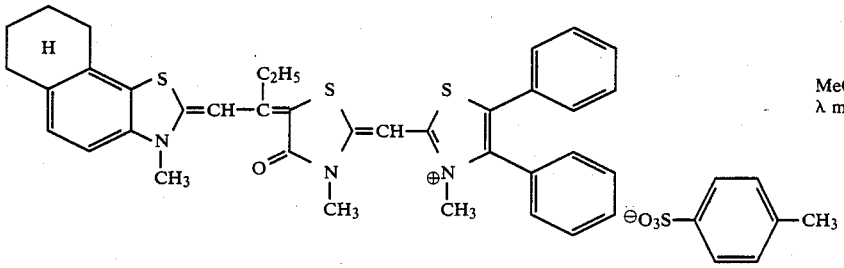
MeOH
λ max 588 nm
I-14
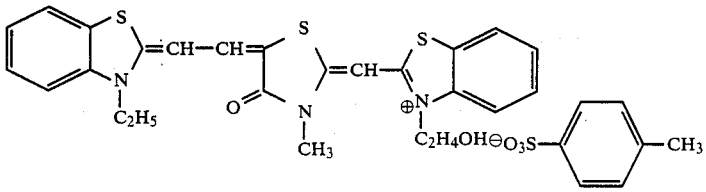
MeOH
λ max 597 nm -continued

I-15

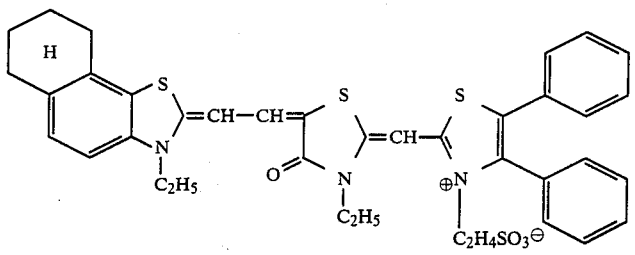

MeOH
λ max 594 nm

I-16

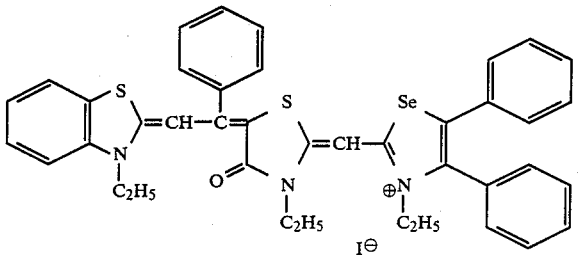

MeOH
λ max 604 nm

I-17

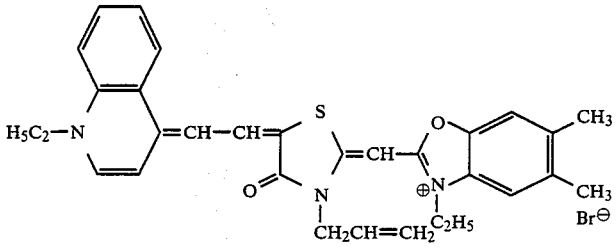

MeOH
λ max 660 nm

I-18

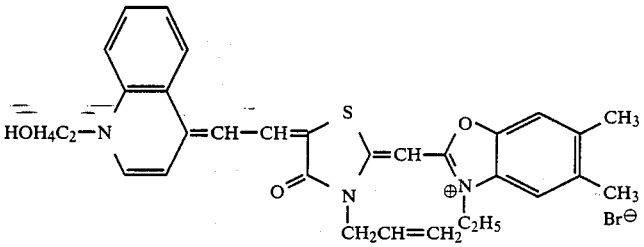

MeOH
λ max 663 nm

I-19

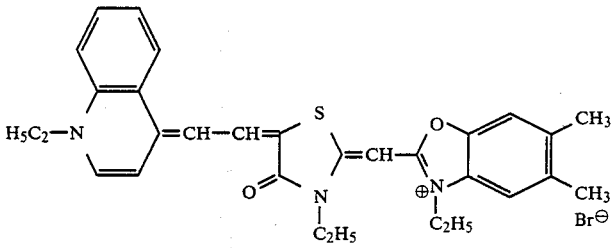

MeOH
λ max 658 nm

I-5, I-6, I-7, I-8, and I-9, among these typical examples, are particularly preferable dyes.

These dyes are used preferably in an amount 0.003 to 0.2 g, in particular, 0.01 to 0.15 g per mol silver halide.

The examples of a fluorine containing ionic surfactant applicable to the invention are described for example in U.S. Pat. Nos. 4,335,201, and 4,347,308, U.K. Pat. Nos. 1,417,915 and 1,439,402, Japanese Patent Examined Publication Nos. 26687/1977, 26719/1982 and 38573/1984, Japanese Patent O.P.I. Publication Nos. 149938/1980, 48520/1979, 14224/1979, 200235/1983, 146248/1982 and 196544/1983.

The preferred typical examples of the dye are as follows:

| | |
|---|---|
| $C_8F_{17}SO_3K$ | F-1 |
| $C_7F_{15}COONa$ | F-2 |
| $C_8F_{17}CH_2CH_2OSO_3Na$ | F-3 |
| $C_8F_{17}SO_2N(C_3H_7)-CH_2COOK$ | F-4 |

-continued

F-5

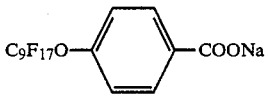

F-6

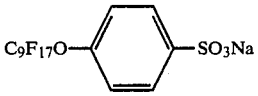

F-7

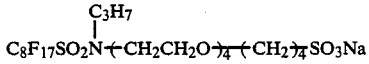

F-8

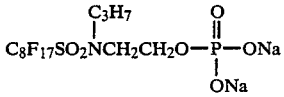

F-9

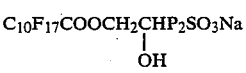

F-10

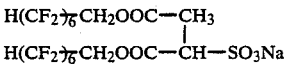

F-11

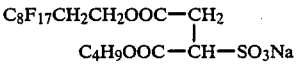

F-12

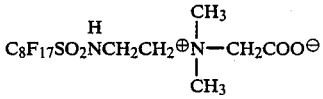

F-13

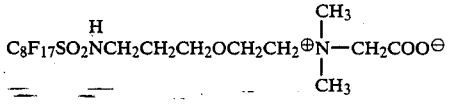

F-14

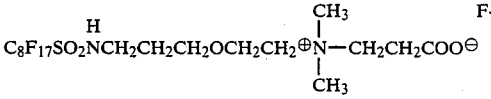

F-15

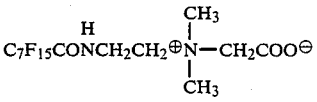

F-16

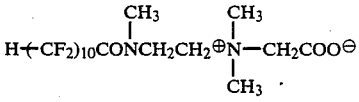

F-17

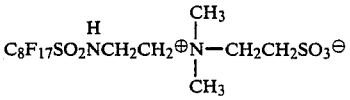

F-18

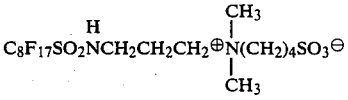

F-19

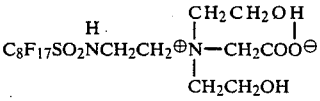

-continued

F-20

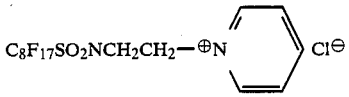

F-21

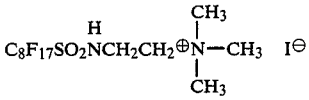

F-22

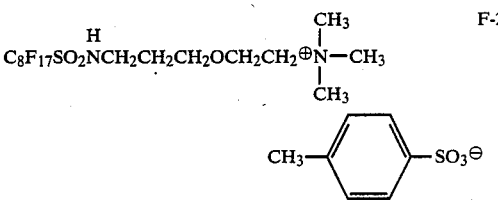

F-23

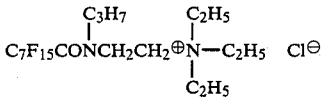

F-24

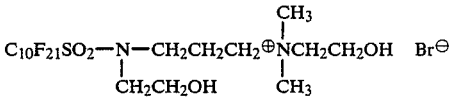

F-25

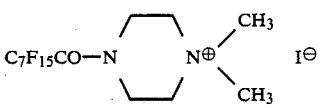

The inorganic salt possibly used in the invention is a halide, a phosphate or a thiocyanate of alkali metal, alkali earth metal or ammonium.

The particularly preferred are halides of alkali metals The typical examples are as follows:

G-1: sodium chloride
G-2: sodium bromide
G-3: potassium iodide
G-4: potassium chloride
G-5: calcium chloride
G-6: rubidium bromide
G-7: magnesium chloride
G-8: ammonium chloride
G-9: sodium phosphate
G-10: potassium phosphate
G-11: sodium potassium phosphate
G-12: potassium thiocyanate The examples of a nonionic surfactant used in the invention include those represented by the following Formulas II, III, and IV.

$$R—L—(CH_2CH_2O)_m—H \qquad \text{Formula II}$$

In Formula II, R represents a substituted or unsubstituted alkyl, alkenyl, or aryl group; L represents an oxygen or sulfur atom, —N—R′ group,

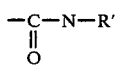

group, or

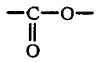

group. R′ represents a hydrogen atom, substituted or unsubstituted alkyl group, or $-(CH_2CH_2O)_m-H$; m represents an integer, 2 to 50.

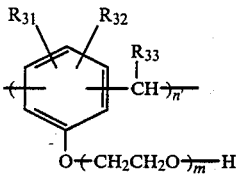

Formula III

In Formula III, $R_{31}$ and $R_{32}$ independently represent a hydrogen or halogen atom, alkoxy carbonyl group; alkyl, alkoxy, or phenyl group, each either substituted or unsubstituted; $R_{33}$ represents a hydrogen atom, methyl group, or α-furyl group; n′ and m represents integers, 2 to 50.

Formula IV

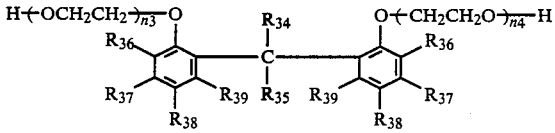

In Formula IV, $R_{36}$ and $R_{38}$ independently represent an alkyl group, aryl group, alkoxy group, halogen atom, acyl group, amide group, sulfonamide group, carbamoyl group or sulfamoyl group, each either substituted or unsubstituted. In this formula, a substituent the phenyl group may have can be unsymmetrical.

$R_{34}$ $R_{35}$ independently represent a hydrogen atom; or an alkyl or aryl group, each either substituted or unsubstituted; each pair of $R_{34}$ and $R_{35}$, $R_{36}$ and $R_{37}$, and $R_{38}$ and $R_{39}$, can be bonded together to form a substituted or unsubstituted ring. $n_3$ and $n_4$ represents an average polymerization degree of an ethylene oxide, and are integers of 2 to 50.

The compounds represented by Formula II, and being used in the invention include those represented by the following formula.

$R-O-(CH_2CH_2O)_m-H$ m=2~50 Formula II-A

In Formula II-A, R represents an alkyl group that may have an unsaturated bond, and, that preferably has 4 to 22 carbon atoms, and whose hydrogen may be substituted with a fluorine atom.

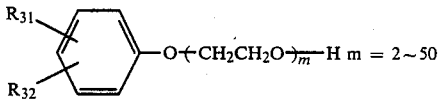

$R_{31}$ and $R_{32}$ may be either identical or different with each other, and independently represent a hydrogen atom, halogen atom, carboxyl group, acyl group, alkoxycarbonyl group, alkyl group, substituted alkyl group, alkoxy group or phenyl group. The hydrogen atom above may be substituted with a fluorine atom.

$R-S-(CH_2CH_2O)_m-H$ m=2~50 Formula II-C

In Formula II-C, R represents an alkyl group that may have an unsaturated bond, and, that preferably has 4 to 22 carbon atoms, and whose hydrogen may be substituted with a fluorine atom.

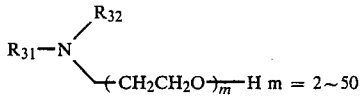

Formula II-D

In Formula II-D, $R_{31}$ represents an alkyl group that preferably has 1 to 20 carbon atoms. $R_{32}$ represents a hydrogen atom; alkyl group with 1 to 20 carbon atoms; fluorine-substituted alkyl group; phenyl group; alkyl-substituted phenyl group; or $-(CH_2CH_2O)_m-H$ group.

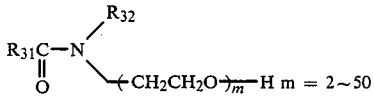

Formula II-E

In Formula II-E, $R_{31}$ represents an alkyl group that preferably has 1 to 20 carbon atoms. $R_{32}$ represents a hydrogen atom; alkyl group with 1 to 20 carbon atoms; fluorine-substituted alkyl group; phenyl group; alkyl-substituted phenyl group; or $-(CH_2CH_2O)_m-H$ group.

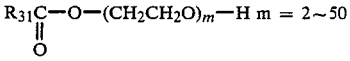

Formula II-F

In Formula II-F, $R_{31}$ represents an alkyl group that preferably has 4 to 22 carbon atoms.

The compounds particularly preferable in embodying the invention, among these represented by Formula II, are as follows:

Example Compounds

II-1 $C_5H_{11}-O-(CH_2CH_2O)_5-H$
II-2 $C_8H_{17}-O-(CH_2CH_2O)_{10}-H$
II-3 $C_{12}H_{25}-O-(CH_2CH_2O)_9-H$
II-4 $C_{13}H_{27}-O-(CH_2CH_2O)_{10}-H$
II-5 $C_{16}H_{33}-O-(CH_2CH_2O)_{10}-H$
II-6 $C_{18}H_{37}-O-(CH_2CH_2O)_{15}-H$
II-7 $H(CF_2CF_2)_5-O-(CH_2CH_2O)_{10}-H$
II-8 $CH_2Cl\ CHClCH_2CH_2O-(CH_2CH_2O)_5-H$

II-9

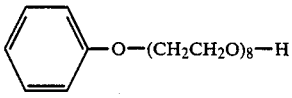

Formula II-B

II-10

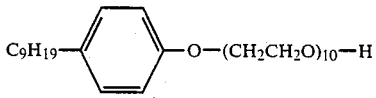

-continued
II-11
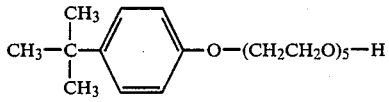
II-12
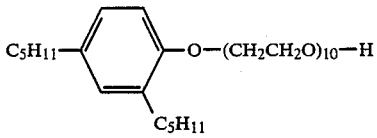
II-13
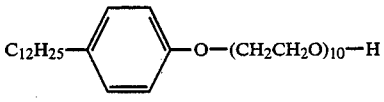
II-14
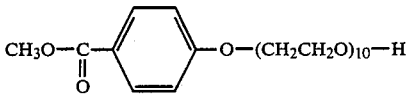
II-15
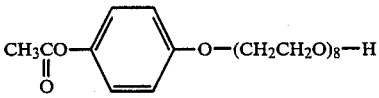
II-16
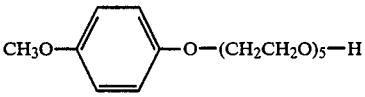
II-17
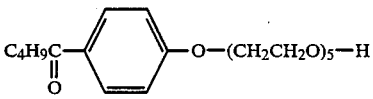
II-18
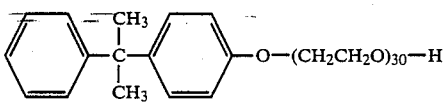
II-19
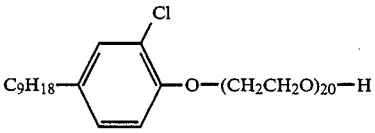
$C_{12}H_{25}-S-(CH_2CH_2O)_{15}-H$ II-20
$C_{18}H_{37}-S-(CH_2CH_2O)_{25}-H$ II-21
$C_{10}H_{21}-S-(CH_2CH_2O)_{5}-H$ II-22
II-23
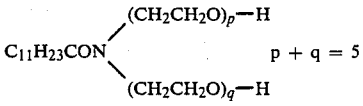
II-24
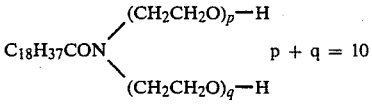
II-25
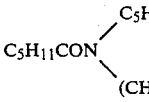
-continued
II-26
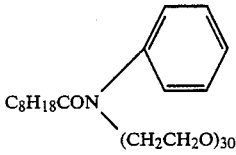
II-27
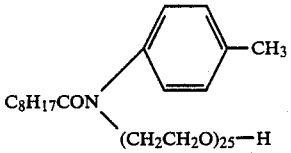
$C_5H_{11}CONH-(CH_2CH_2O)_5-H$ II-28
II-29
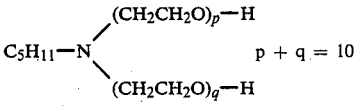
II-30
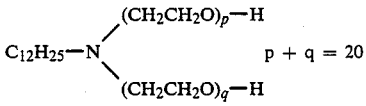
II-31
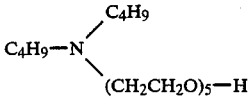
II-32
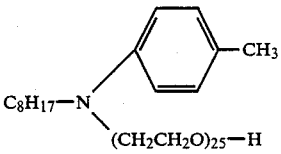
$C_8H_{17}C(=O)-O-(CH_2CH_2O)_{10}-H$ II-33
$C_{15}H_{33}C(=O)-O-(CH_2CH_2O)_{30}-H$ II-34
$C_{10}H_{21}C(=O)-O-(CH_2CH_2O)_{10}-H$ II-35
Next, the typical examples of a compound represented by Formula III are as follows:
III-1
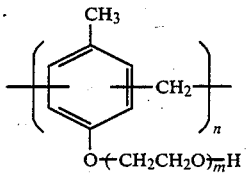
n = 20 m = 15
III-2
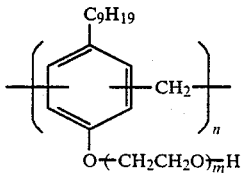
n = 6 m = 10

-continued
III-3
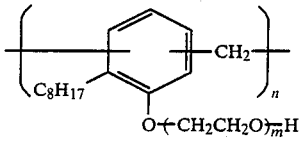
n = 10 m = 15
III-4
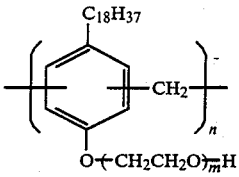
n = 15 m = 20
III-5
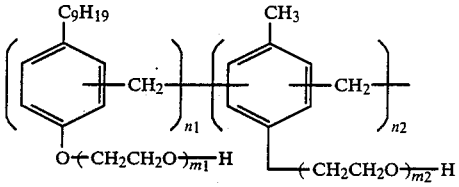
$n_1:n_2$ = 30:20 $m_1 + m_2$ = 15
III-6
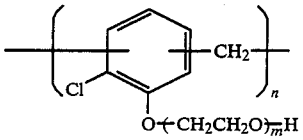
n = 5 m = 5
III-7
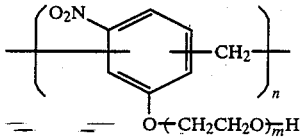
n = 15 m = 15
III-8
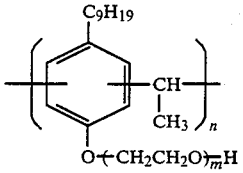
n = 30 m = 20
III-9
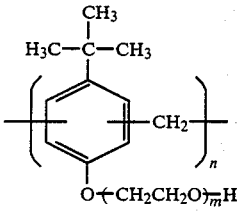
n = 50 m = 5
III-10
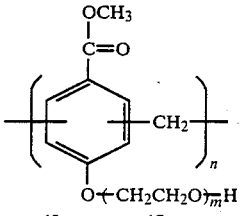
n = 40 m = 17
-continued
III-11
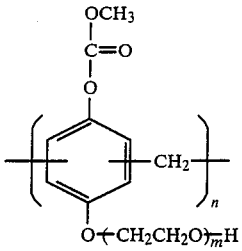
n = 25 m = 17
III-12
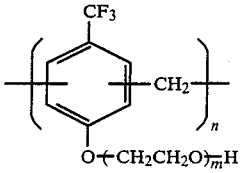
n = 12 m = 15
III-13
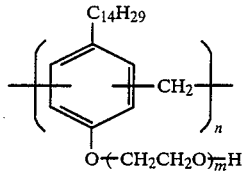
n = 6 m = 30
III-14
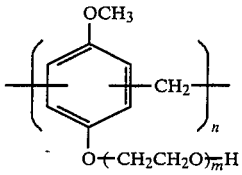
n = 18 m = 10
III-15
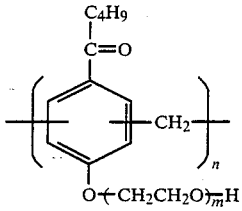
n = 18 m = 10
III-16
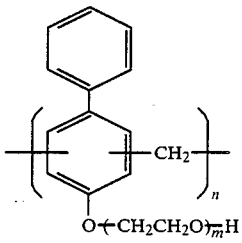
n = 9 m = 30
III-17
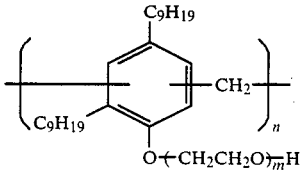
n = 10 m = 20

-continued
III-18
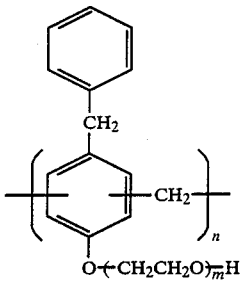
n = 15 m = 30
III-19
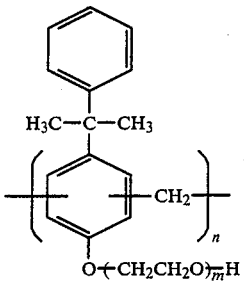
n = 10 m = 45
III-20
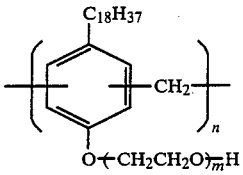
n = 20 m = 20
The typical examples of a compound represented by Formula IV, and used in the invention, are as follows:
IV-1
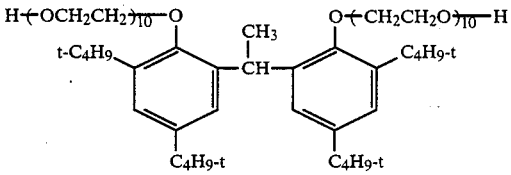
IV-2
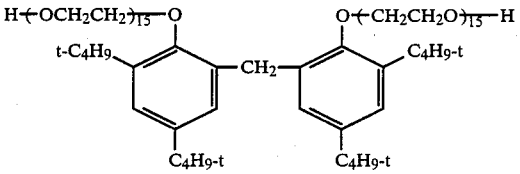
IV-3
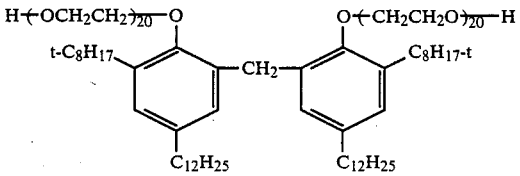
-continued
IV-4
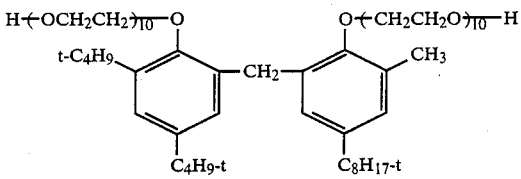
IV-5
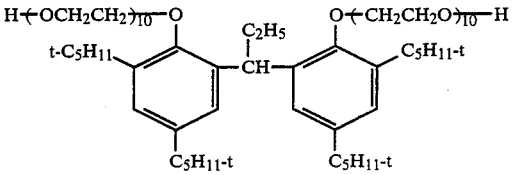
IV-6
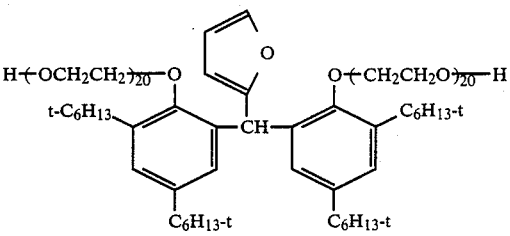
IV-7
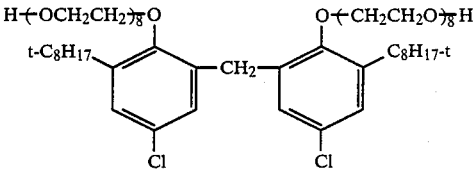
IV-8
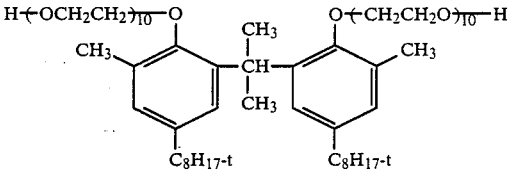
IV-9
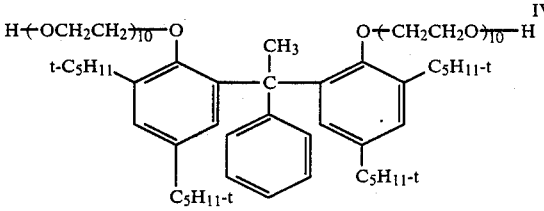
IV-10
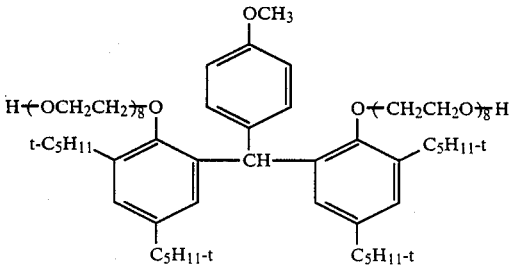

-continued

IV-11

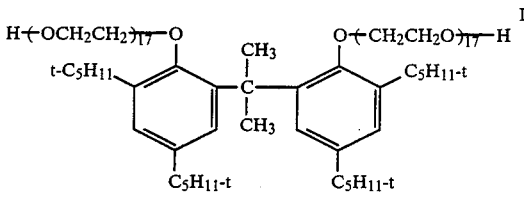

IV-12

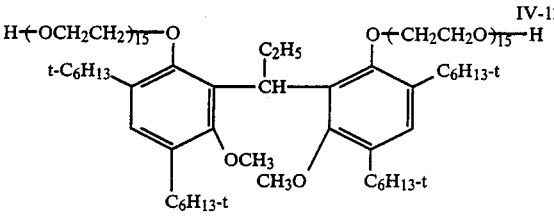

IV-13

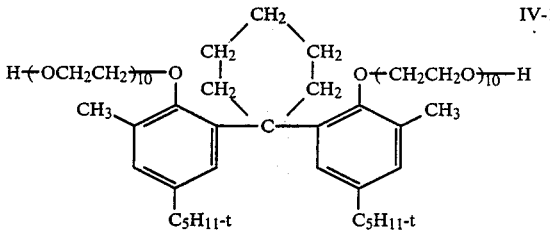

IV-14

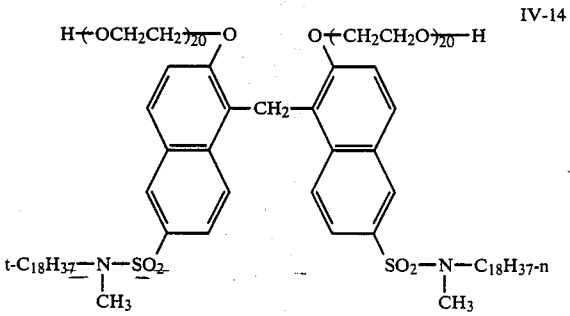

A fluorine-containing ionic surfactant of the invention is used at a rate of 0.0001 to 1 g, or, preferably, 0.0005 to 0.1 g per 1 $m^2$ light-sensitive material.

An amount of an inorganic salt used is 0.005 to 1 g, or, preferably, 0.01 to 0.5 g per 1 $m^2$ light-sensitive material.

An amount of a nonionic surfactant used is 0.001 to 2 g, or, preferably, 0.005 to 0.5 g per 1 $m^2$ light-sensitive material.

It is preferable to use a condensation product of a compound of Formula V and an aldehyde.

Formula V

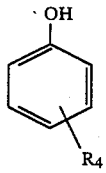

In this formula, $R_4$ represents a hydrogen atom; an alkyl or a cycloalkyl group.

The example compounds represented by Formula V include phenol, cresol, isopropylphenol, t-butylphenol, t-aminophenol, hexylphenol, t-octylphenol, cyclohexylphenol, and isopropylcresol, and, among all, those particularly preferred are phenol, cresol, and t-butylphenol.

The examples of aldehydes possibly used in the invention are aliphatic and aromatic aldehydes such as formaldehyde, acetaldehyde, acrolein, crotonaldehyde, and furfural, and the examples include those having 1 to 6 carbon atoms. The particularly preferred among them are formaldehyde and acetaldehyde.

Allowing 7 mol of a phenol represented by Formula V above to react with not more than 6 mol of an aldehyde can produce a condensation product (novorac resin) than is soluble in an aqueous alkali solution or in organic solvent.

The preferred amount of this condensation product being used is 0.01 to 2 g, in particular, 0.03 to 1.3 g per mol silver halide.

It is favorable, in embodying the invention, to use a multivalent alcohol which has a melting point of not less than 40° C. and at least two hydroxide groups in the molecular structure. More specifically, such a multivalent alcohol is one that has within its molecular structure 2 to 12 hydroxide groups, and 2 to 20 carbon atoms, wherein there is not conjugation between a certain hydroxide group and another hydroxide group with a conjugated bond, in other words, such an alcohol is one whose oxidation product is theoretically non-existent. The particularly favorable among such alcohols are those having a melting point 50° to 300° C.

The typical examples of such alcohols are as follows. However, the scope of the invention is not limited only to these examples.

| No. | Compound | Melting point (°C.) |
|---|---|---|
| 1 | 2,3,3,4-tetramethyl-2,4-pentanediol | 76 |
| 2 | 2,2-dimethyl-1,3-propanediol | 126–128 |
| 3 | 2,2-dimethyl-1,3-pentanediol | 60–63 |
| 4 | 2,2,4-trimethyl-1,3-pentanediol | 52 |
| 5 | 2,5-hexanediol | 43–44 |
| 6 | 2,5-dimethyl-2,5-hexanediol | 92–93 |
| 7 | 1,6-hexanediol | 42 |
| 8 | 1,8-octanediol | 60 |
| 9 | 1,9-nonanediol | 45 |
| 10 | 1,10-decanediol | 72–74 |
| 11 | 1,11-undecanediol | 62–62.5 |
| 12 | 1,12-dodecanediol | 79–79.5 |
| 13 | 1,13-tridecanediol | 76.4–76.6 |
| 14 | 1,14-tetradecanediol | 83–85 |
| 15 | 1,12-octadecanediol | 66–67 |
| 16 | 1,18-octadecanediol | 96–98 |
| 17 | cis-2,5-dimethyl-3-hexane-2,5-diol | 69 |
| 18 | trans-2,5-dimethyl-3-hexane-2,5-diol | 77 |
| 19 | 2-butine-1,4-diol | 55 |
| 20 | 2,5-dimethyl-3-hexyne-2,5-diol | 95 |
| 21 | 2,4-hexadiyne-1,6-diol | 111–112 |
| 22 | 2,6-hexadiyne-1,8-diol | 88.5–89.5 |
| 23 | 2-methyl-2,3,4-butanetriol | 49 |
| 24 | 2,3,4-hexanetriol approx. | 47 |
| 25 | 2,4-dimethyl-2,3,4-pentanetriol | 99 |
| 26 | 2,4-dimethyl-2,3,4-hexanetriol | 75 |
| 27 | pentane methyl glyceline | 116–117 |
| 28 | 2-methyl-2-oxymethyl-1,3-propanediol | 199 |
| 29 | 2-isopropyl-2-oxymethyl-1,3-propanediol | 83 |
| 30 | 2,2-dihydroxymethyl-1-butanol | 58 |
| 31 | erythritol | 126 |
| 32 | D-threitol | 88 |
| 33 | L-threitol | 88–89 |
| 34 | rac-threitol | 72 |
| 35 | pentaerythritol | 260–265 |
| 36 | 1,2,3,4-pentanetetrol | 106 |
| 37 | 2,3,4,5-hexanetetrol | 162 |
| 38 | 2,5-dimethyl-2,3,4,5-hexanetetrol | 153–154 |
| 39 | 1,2,5,6-hexanetetrol | 95 |
| 40 | 1,3,4,5-hexanetetrol | 88 |
| 41 | 1,6-(erythro-3,4)-hexanetetrol | 121–122 |
| 42 | 3-hexane-1,2,5,6-tetrol | 80–82 |
| 43 | 3-hexyne-1,2,5,6-tetrol | 113–114.5 |

-continued

| No. | Compound | Melting point (°C.) |
|---|---|---|
| 44 | adonitol | 102 |
| 45 | D-arabitol | 102 |
| 46 | L-arabitol | 102 |
| 47 | rac-arabitol | 105 |
| 48 | xylitol | 93–94.5 |
| 49 | mannitol | 164 |
| 50 | dulcitol | 188.5–189 |

Though not specifically limited, an amount being added of each of the above-mentioned compounds No. 1 through 50 is 1 to 100 g, or, preferably, 5 to 50 g per mol silver halide. The above-mentioned compounds No. 1 through 50 are added to a silver halide emulsion layer or a layer adjacent thereto. Such a compound is preferably added to a light-sensitive silver halide emulsion. The timing for addition is arbitrarily determined, and, usually, it is from after the completion of chemical sensitization to during coating operation. As a method of addition, such a compound can be directly dispersed in hydrophilic colloid, or such a compound may be dissolved in an organic solvent such as methanol and acetone, and then such a solvent is added to the silver halide emulsion.

The silver halide composition of a light-sensitive silver halide emulsion used in the invention is preferably AgBrI, or, more specifically, AgBrI that contains AgI at a range not less than 0.5 mol % to not more than 10 mol %.

A photographic emulsion being incorporated into a light-sensitive material of the invention is prepared by an acid process, neutral process, or ammonium process. To allow soluble silver salt with soluble halide is performed based on any of a single jet precipitation process, and double jet precipitation process, and combination thereof. The so-called "reverse precipitation process" can be used for this purpose.

A surface latent image type silver halide emulsion can be prepared by a so-called "control double jet process" where the pH and EAg in a reaction vessel are controlled, for example, by gradually increasing amount added of a silver ion solution and halide solution.

During formation or physical ripening of silver halide grains may be allowed to be present cadmium, palladium salt, zinc, lead salt, thalium slat, salt or complex salt of iridium, salt or complex salt of rhodium, salt or complex salt of iron, or the like.

A surface latent image type silver halide emulsion can be a monodispersed emulsion. The monodispersed emulsion means an emulsion where;

if the average grain size of the silver halide grains is $\bar{r}$, and if the standard deviation of the size is $\delta$ $\delta/\bar{r}=0.20$ According to this specification, the term "average grain size" means an average size of spherical silver halide grains; if the grains are of other configurations, the average size is indicated as an average of diameters of disks converted from, and having same areas of, projected images of the grains.

A surface latent image type silver halide emulsion can be chemically sensitized using a known method. Available methods of chemical sensitization include sulfur sensitization and gold sensitization, wherein these sensitization techniques can be used in combination.

An amount of a sulfur sensitizer to be added varies significantly depending on various conditions. Usually, such an amount is $1\times10^{-7}$ to $1\times10^{-2}$ mol per mol silver. An amount of a gold sensitizer to be added also varies significantly depending on various conditions. Usually, such an amount is $1\times10^{-9}$ to $1\times10^{-2}$ mol per mol silver.

A blending ratio between a sulfur sensitizer and a gold sensitizer in a sulfur/gold sensitization technique varies depending on ripening conditions and the like. Usually, the ratio is 1 to 1000 mol sulfur sensitizer per mol gold sensitizer. A gold sensitizer can be added to a silver halide emulsion at that same time as that of a sulfur sensitizer, or during or after sulfur sensitization.

These chemical sensitizers are added to silver halide emulsions, in the form of an aqueous solution if they are water-soluble compounds; while if they are organic solvent-soluble compounds, they are added in the form of a solution of an organic solvent, which is readily mixed with water, such as methanol and ethanol.

The chemical sensitization conditions, such as pH, pAg, and temperature, are not specifically limited. However, the preferred pH level is 4 to 9, in particular, 5 to 8; pAg level, 5 to 11, in particular 8 to 10. The preferred temperature is 40° to 90° C., in particular, 45° to 75° C.

In conjunction with the above-mentioned sulfur sensitization, or gold/sulfur sensitization, the photographic emulsion used in the invention can be subjected to a reducing sensitization technique that uses a reducing substance; or to a noble metal sensitization technique that used a noble metal compound.

The above mentioned light-sensitive emulsions can be used singly or in combination.

In embodying the invention, it is allowable to use, after completion of the chemical sensitization above, any of various stabilizers such as 4-hydroxy-6-methyl-1,3,3a,7-tetrazaindene, 5-mercapto-1-phenyltetrazole, and 2-mercaptobenzothiazole.

With regards to the size distribution of light-sensitive silver halide grains used in the invention, in order to ensure the previously described contrast $\gamma=1.0$ to 2.5 so as to make scanning-induced density irregularities less visible, it is preferable that at least 80% of total number of silver halide grains present in the silver halide emulsion has a grain size within a range of size 0.1 to 1.2 $\mu$m, in particular, 0.2 to 0.7 $\mu$m.

The light-sensitive material of the invention can take various constitutions. For example, a silver halide emulsion layer can be formed on one face or both faces of a support. An auxiliary layer such as a protective layer, and anti-hallation layer, can be disposed in an arbitrary position. When an emulsion layer is formed on one face alone, the other face can be provided, as a backing layer, with a layer comprising hydrophilic colloid of gelatin or the like. For the reasons, such as easier indentification of front/back of the light-sensitive material, the backing layer may incorporate an arbitrary dye.

The preferred layer constitution of the light-sensitive material of the invention comprizing a support provided on which one face alone, a silver halide emulsion layer, and on the other face is formed a backing layer containing an arbitrary dye.

According to the invention, the light-sensitive silver halide grains are incorporated into the photographic structural layers as dispersed in an arbitrary binder. The useful binders are various hydrophilic colloids. The typical preferred example is gelatin. To improve physical properties of the coated layer having the above hydrophilic colloid as a binder, an arbitrary layer-property improving agent such as a hardener is preferably used in compliance with a specific requirement.

In addition to the above-mentioned hardener, the coating composition having hydrophilic colloid as a binder can incorporate, within a range that does not hinder the effect of the invention, photographic additives such as gelatin plasticizer, surfactant other than that of the invention, ultraviolet absorbent, anti-stain agent, pH adjuster, antioxidant, anti-static agent, thickener, graininess improving agent, dye, mordant, whitening agent, developing speed controlling agent, matting agent, silver halide developer.

To prevent desensitization or fogging that may be originated in manufacturing process, storage, or in photographic processing of the light-sensitive material, the above-mentioned photographic emulsion can incorporate the following various compounds.

These compounds are those known as stabilizers in the photographic art, and whose examples include an azole, a nitroindazole, a triazole, a benzotriazole, a benzimidazole; a mercapto compound such as a heterocyclic mercapto compound, a mercaptothiazole, a mercaptobenzothiazole, a mercaptobenzimidazole, and a mercaptopyridine; a thioketo compound; an azaindene; a mercaptoazaindene; a benzenethiosulfonic acid; and a benzenesulfinic acid.

A part of these compounds useful are described by referring to literatures and documents, in "The Theory of the Photographic Process", by K. Mees, 3 ed., 1966.

For the more specific examples of usage thereof, descriptions for example in U.S. Pat. Nos. 3,954,474, 3,982,947, and 4,021,248 can be referred to.

The anti-fogging agents or stabilizers particularly preferably used in the invention include compounds represented by the following Formulas VI, VII, VIII and IX; and nitron compounds.

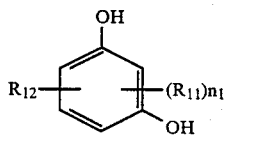

VI

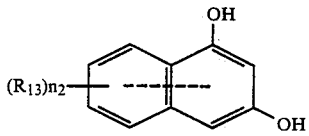

VII

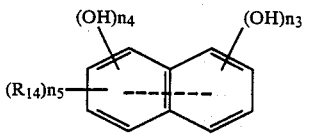

VIII

In these examples, $R_{11}$ represents a hydrogen atom, a halogen atom, a hydroxyl group, possibly substituted alkyl group, possibly substituted aralkyl group, possibly substituted alkoxy group, possibly substituted acyl group, possibly substituted carboxymethyl group, —COOM group or —$SO_3M$ group (M represents a hydrogen atom, alkali metal atom, or ammonium group); $R_{12}$, $R_{13}$, and $R_{14}$ independently represent a —COOM group or —$SO_3M$ group, $n_1$ and $n_2$, an integer of 1 to 3; $n_3$ represents 1 or 2; $n_4$ and $n_5$, 0 or 1; provided that $n_3$ and $n_4$ cannot be commonly 0. If $n_1$ and $n_2$ are 2 or 3, $R_{11}$ and $R_{13}$ may be either identical or different with each other.

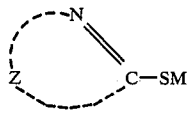

IX

In the formula, Z represents an atomic group that is needed for forming, in conjunction with C=N, a five- or six membered heterocycle comprizing a carbon atom, nitrogen atom, oxygen atom, and sulfur atom.

Such a heterocycle may be interlinked one, and the examples of which include a tetrazole ring, a triazole ring, an imidazole ring, a thiadiazole ring, an oxadiazole ring, an oxazole ring, a benzthiazole ring, a benzimidazole ring, a benzoxazole ring, a purine ring, an azaindene ring, a tri-tetra-pentapyridine ring, and a pyridine ring.

These heterocycles may have a substituent such as an alkyl group, an alkoxy group, an amino group, a nitro group, a halogen atom, a carbamoyl group, an alkylthio group, and a mercapto group. Those preferred among the compounds represented by this formula are compounds wherein Z forms, together with C=N, a tetrazole ring, a triazole ring, a thiadiazole ring, a benzimidazole ring, a benzothiazole ring. The most favorable compounds are those wherein Z, in conjunction with, forms a thiadiazole ring. In this formula, M represents a hydrogen atom, —$NH_4$ group, or alkali metal atom.

Among those compounds represented by Formulas VI, VII, VIII, and IX, the typical examples used particularly preferably in the invention are those described in page 57 of Japanese Patent O.P.I. Publication No. 60447/1988.

Next, the compound represented by the following Formula Xa can be preferably used in the invention.

Formula Xa

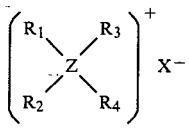

In Formula Xa, Z represents a phosphorus or nitrogen atom; $R_1$, $R_2$, $R_3$, and $R_4$ independently represent a substituted or unsubstituted alkyl group, aryl group, or aralkyl group, provided that at least one of $R_1$, $R_2$, $R_3$, and $R_4$ is an aryl or aralkyl group having an electron attracting substituent group. $X^-$ represents an acid anion.

Among the compounds represented by Formula Xa, and possibly used in the invention, those advantageously used in embodying the invention are those represented by Formula Xb below.

Formula Xb

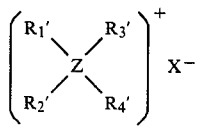

In Formula Xb, Z represents a phosphorus or nitrogen atom; $R_1'$, $R_2'$, $R_3'$, and $R_4'$ independently represent a substituted or unsubstituted alkyl group having 1 to 6 carbon atoms, a phenyl group, a tolyl group, a xylyl group, a biphenyl group, a naphthyl group, or an anthryl group, The examples of a substituent which $R_1'$, $R_2'$, $R_3'$, and $R_4'$ may have include —$CH_3$, —OH, —CN, —$NO_2$, or a halogen atom, an acyl group, a carboxyl group, a sulfonyl group, a quaternary amino group, and a phenyl group. The number of such substituents is 1 or 2. These definitions hold only when at least one of $R_1'$, $R_2'$, $R_3'$, and $R_4'$ is an aryl or an aralkyl group that has an electron attracting substituent such as a nitro group, a cyano group, a halogen atom, an acyl group, a carboxyl group, a sulfonyl group, a quaternary amino group. $X^-$ represents an acid anion such as $Br^-$, $Cl^-$, $I^-$, $ClO_4$—, $BF_4$—.

The compound represented either by Formula Xa or Xb above can be synthesized by a method described in U.S. Pat. No. 3,951,661.

The typical examples advantageously used in the invention, among compounds represented by Formulas Xa and Xb are those described in the previously mentioned Japanese Patent O.P.I. Publication No. 604471/1988, page 60.

Various compounds are available as a nitron compound used as an anti-fogging agent or a stabilizer.

For example, the useful nitron compounds include those that are described in Journal of the Chemical Society, vol. 1, page 824–825 (1938), and that are represented by Formulas X and XI below, as well as inorganic acid salts and organic acids salts of nitron compounds. The salt examples of such a compound include chlorates, boromates, perchlorates, hydrogensulfates, and acetates of the above-mentioned nitron compounds.

Structural Formula X

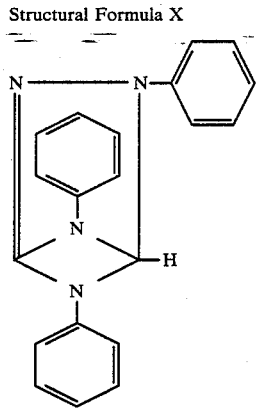

Structural Formula XI

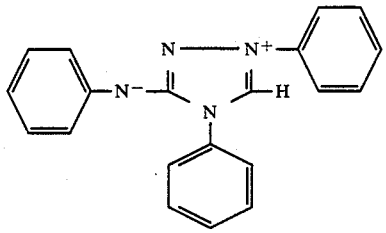

In addition, compounds below described in Japanese Patent O.P.I. Publication Nos. 122936/1985, and 117240/1985 can be used.

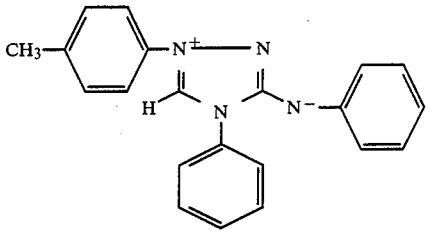

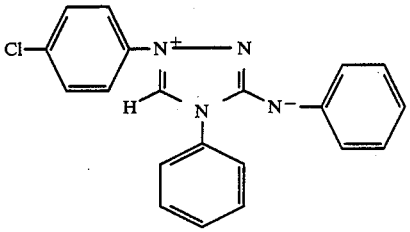

Compounds represented by Formula B below are useful too.

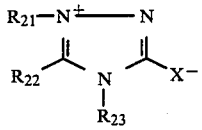

In this formula, X represents a sulfur atom, or —N—$R_{24}$; while $R_{21}$, $R_{22}$, $R_{23}$, and $R_{24}$ independently represent a substituted or unsubstituted alkyl group, aryl group, or heterocycle. If $R_{24}$ is a hydrogen atom, $R_{21}$ through $R_{23}$ represents those other than a hydrogen atom. $R_{21}$ and $R_{22}$, or $R_{22}$ and $R_{23}$, or $R_{23}$ and $R_{24}$, may be bonded together to form a ring.

With Formula B, the examples of a substituted or unsubstituted alkyl group include a substituted or unsubstituted linear-chained alkyl group such as a methyl group, ethyl group, and n-octyl group; substituted or unsubstituted branch-chained alkyl group such as an isopropyl group, isobutyl group, 2-ethylhexyl group, and t-butyl group; substituted or unsubstituted cycloalkyl group such as a cyclopropy group, cyclopentyl group, and cyclohexyl group; while the examples of a substituted or unsubstituted aryl group include a substituted or unsubstituted phenyl and naphthyl group. The examples of a substituted or unsubstituted heterocycle include a substituted or unsubstituted 3-pyridyl group, 2-furyl group, and 2-benzothiazolyl group.

The examples of a substituent group which may be present on $R_{21}$, $R_{22}$, $R_{23}$, and $R_{24}$ include a halogen atom, nitro group, cyano group, alkoxy group, carbamoyl group, sulfamoyl group, carboxy group, alkoxy carbonyl group, sulfo group, amide group, sulfonamide group, hydroxy group, sulfonyl group, sulfiniyl group, sulfenyl group, mercapto group, amino group, ureide group, aminocarbonyloxy group, alkoxycarbonylamino group, aryl group, and heterocycle, wherein one or more such substituents can be present.

$R_{21}$ and $R_{22}$, or $R_{22}$ and $R_{23}$, or $R_{23}$ and $R_{24}$, may be bonded together to form a ring such as a five-or six-membered ring.

Among the compounds represented by Formula B, those preferably used in the invention are those described in page 64 in the previously-mentioned Japanese Patent O.P.I. Publication No. 60447/1988.

A photographic emulsion used in the invention preferably incorporates a compound represented by Formula XII below in order to prevent image quality deterioration of a photographic image formed for example in ultra-rapid developing at a high pH and high temperature, as well as to improve graininess of the similar image.

Such a compound is added in an amount, as specified in Japanese Patent O.P.I. Publication No. 158631/1983, 0.001 to 2 mg, or, preferably, 0.01 to 1 mg per gram binder.

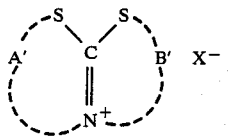

Formula XII

In this formula, A', and B' independently represent a non-metal atomic group necessary for forming a heterocycle in conjunction with S and N; while X represents an anion such as $Cl^-$, $Br^-$, $ClO^-$, and $CH_3SO_3$—.

Formula XII is described in further detail. The preferred compound represented by Formula XII is a compound whose non-metal atomic group A' and/or B' needed for forming a heterocycle of whom is (wherein

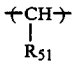

represents a hydrogen atom, or lower alkyl group while n represents 2 or 3).

Among those represented by Formula XII, the typical compounds preferably used in the invention are those described in page 65 in the previously mentioned Japanese Patent O.P.I. Publication No. 60447/1988.

A matting agent used in the invention can be either a polymer matting agent or inorganic matting agent. A matting agent used can have an arbitrary grain configuration. However, when a light-sensitive material has an emulsion layer on one face alone, the matting agent on the emulsion layer side has preferably tabular grains. The preferred average grain size of a matting agent on the emulsion layer side is not more than 1.5 times of "emulsion layer thickness+protective layer thickness".

The typical supports possibly used in the light-sensitive material of the invention include baryta paper, polyethylene-coated paper, polypropyrene synthetic paper, glass plate, cellulose acetate, cellulose nitrate, polyester films of, for example, polyethylene terephthalate; polyamide film, polypropyrene film, polycarbonate film, and polystyrene film. The particularly preferable is a polyethylene terephthalate that is dyed to blue as strongly as for medical radiography.

The light-sensitive material of the invention can be developed by any known method. A suitable method is a high temperature, rapid process with an automatic developing machine. The particularly suitable method is a developing method for medical radiography. In a developer for the photographic developing process of medical radiography, the preferred developing agent is a combination of a hydroquinone and a 3-pyrazolidone, or hydroquinone and an aminophenol. The preferred developing conditions include a temperature of are 30° to 40° C., and developing time of 10 to 40 seconds.

The preferred fixer is an aqueous solution containing thiosulfate and water-soluble aluminum compound, and whose pH is 4 to 5.

The present invention is capable of providing a silver halide photographic light-sensitive material for a laser light exposure, wherein the silver halide photographic light-sensitive material is characterized by less conspicuous scanning-induced density irregularities, sufficient maximum density, pure black tone (cold tone) of a resultant reproduced image, and the light-sensitive material is capable of providing a high quality recorded image, and free from loss in sensitivity, and excels in red-sensitivity, and has improved resistance against fluctuation in photographic performance that is otherwise affected by developing conditions.

The light-sensitive material of the invention is exposed using a laser beam. For this purpose, a He-Ne laser is particularly advantageous because of stableness in performance, durability and the like.

A compound represented by Formula I and preferably used is one that is capable of sensitizing a silver halide emulsion to be sensitive to a red wave region that includes a wave-length region a He-Ne laser has. According to the invention, the problem of the sensitizing dye is improved.

EXAMPLES

The present invention is hereunder described in further detail by referring to examples of the invention.

It should be understood that the scope of the invention is not limited by these examples. Example 1

While stirring, at 40° C., 1 lit. of solution containing 130 g of KBr, 2.5 g of KI, 30 mg of 1-phenyl-5-mercaptotetrazole, and 15 g of gelatin, 500 ml of solution containing 0.5 mol of ammonia silver nitrate was added in 1 minute, and 2 minutes after, acetic acid was added in order to adjust the pH of the solution to 6.0. Next, 1 minute after, 500 ml of solution containing silver nitrate was added in 1 minute, and after 15 minutes of stirring, an aqueous solution containing formaline condensation product of sodium naphthalenesulfate as well as containing magnesium sulfate was added to coagulate the resultant emulsion. The resultant supernatant was removed, and then, 2 lit of 40° C. water was added, and after 10 minutes of stirring, an aqueous magnesium sulfate solution was added again to coagulate the emulsion. Once the resultant supernatant was removed, 300 ml of 5% gelatin solution was added, and the mixture was stirred for 30 minutes at 55° C. to form Emulsion A. This emulsion had an average silver halide grain size of 0.40 μm, wherein 90% of the total grains was included within a range of 0.2 to 0.7 μm.

To the emulsion were added, per mol silver halide, 5 mg of sodium thiosulfate, 20 mg of ammonium thiocyanate, and 3 mg of chloroauric acid, and the emulsion was allowed to chemically ripen at 60° C. for 80 minutes.

To the resultant emulsion was added, per mol silver halide, 1.0 g of a novolac resin obtained from phenol and formaldehyde, and was also added 60 mg of sensitizing dye of Formula I or Comparison Sensitizing Dye S, and then, 1.0 g of 4-hydroxy-6-methyl-1,3,3a,7-tetrazaindene was added for stabilization. A sensitizing dye used in each emulsion is specified in Table 1.

Comparison Sensitizing Dye S

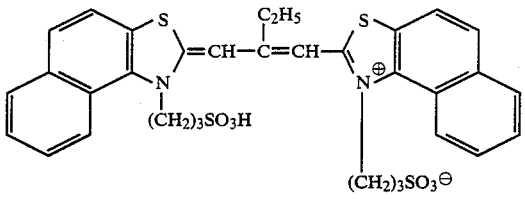

A copolymer comprising three types of monomeric components, i.e. 50 wt % of glycidyl methacrylate, 10 wt % of methyl acrylate, and 40 wt % of butyl methacrylate was diluted in order to prepare an aqueous copolymer dispersion so that the concentration was 10 wt %, and the dispersion as a subbing solution was applied to and dried on one face of a polyethylene terephthalate base. A backing layer was formed on the other face of the base by using a backing layer solution comprising 400 g of gelatin, 2 g of polymethyl methacrylate, 6 g of sodium dodecylbenzenesulfonate, 20 g of anti-hallation dye below, and glyoxal. The backing layer solution was applied simultaneously with a protective layer solution comprising gelatin, matting agent, glyoxal, and sodium dodecylbenzenesulfonate. Thus a support having a backing layer was obtained. The coating gelatin weights respectively in the backing and protective layers were 2.5 g/m$^2$ and 2.0 g/m$^2$.

Anti-hallation dye

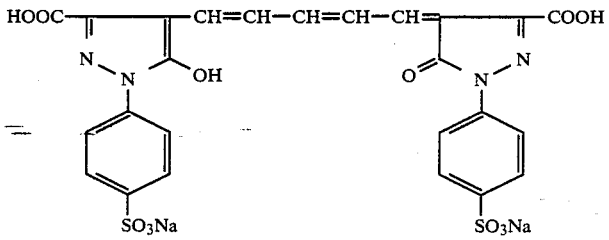

Preparation of coated samples

As additives for an emulsion layer were added, per mol silver halide, 10 g of diethylene glycol, 50 mg of nitrophenyl-triphenylphosphonium chloride, 1 g of ammonium 1,3-dihydroxybenzene-4-sulfonate, 10 mg of sodium 2-mercaptobenzimidazole-5-sulfonate, and 35 mg of

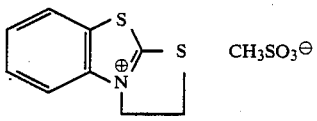

1 g of

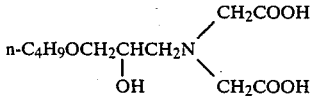

10 mg of 1,1-dimethylol-1-bromo-1-nitromethane, and 100 mg of

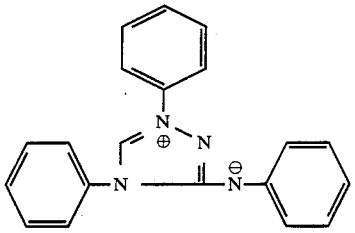

As additives for an emulsion protective layer, per gram gelatin were added 20 mg of a compound below.

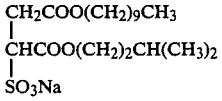

and 7 mg of matting agent comprising silica of average grain size 7 μm, and 70 mg of colloidal silica whose average grain size being 0.013 μm. Also added were an example fluorine-containing ionic surfactant, nonionic surfactant and inorganic salt; as well as formaldehyde and glyoxal each serving as a hardener. The types and amounts added of a fluorine-containing ionic surfactant, nonionic surfactant, and inorganic salt are listed in Table 1.

Upon the support base having a backing layer were sequentially, and simultaneously formed, by slide hopper method, in the order of a silver halide emulsion layer, and an emulsion protective layer, at a coating velocity of 60 m/min. Thus each sample was obtained. The coating silver weight was 2.5 g/m$^2$; coating gelatin weight was 3 g/m$^2$ in the emulsion layer and 1.3 g/m$^2$ in the emulsion protective layer.

The so-prepared samples were allowed to stand for 3 days at 23° C. and 55%RH, and then, the samples were exposed under varied exposures, with 1/100,000 second exposure time per pixel (100 μm$^2$), by using He-Ne laser beam. Then the samples were treated with an automatic developing machine for radiography (commercial name, Konica X-ray automatic developing machine, KX-500) manufactured by Konica Corporation. The processing solutions used were a developer for X-ray automatic developing machine (commercial name, KD-90) manufactured by Konica Corporation, and fixer (commercial name, XF, manufactured by Konica) for the similar application, and the samples were processed at variously changed developer temperatures. The processing-induced density irregularities were evaluated using 8″ × 10″ samples uniformly exposed at a common exposure, and by subjecting these samples to the process identical to the above-mentioned process.

Samples undergone developing were evaluated for sensitivity, gradation, (density, 1.0 to 2.0), coloration of developed silver, maximum density, and density irregularities. The sensitivity indicated here is an exposure that is necessary to provide density level of fog+1.0, and is a value relative to the similar exposure of Sample 1, i.e. 100.

TABLE 1

| No. | Fluorine-containing ionic surfactant | Nonionic surfactant | Inorganic salt | Sensitizing dye | 35° C. developing: Sensitivity S | 35° C. developing: Coloration | Dependency on processing conditions: S35° C./S32° C. | Dependency on processing conditions: γ35° C./γ32° C. | Processing-induced density irregularities | Remarks |
|---|---|---|---|---|---|---|---|---|---|---|
| 1 | None | None | None | I-1 | 100 | 2 | 1.22 | 1.30 | 2 | Comparison |
| 2 | None | None | None | Comparison S | 80 | 2 | 1.20 | 1.31 | 2 | |
| 3 | F-1 (5 mg/m$^2$) | None | None | I-1 | 95 | 2 | 1.23 | 1.30 | 3 | |
| 4 | None | II-10 (10 mg/m$^2$) | None | I-1 | 96 | 1 | 1.25 | 1.33 | 3 | |
| 5 | None | None | G-1 (100 mg/m$^2$) | I-1 | 98 | 2 | 1.22 | 1.32 | 3 | |
| 6 | F-1 (5 mg/m$^2$) | II-10 (10 mg/m$^2$) | None | I-1 | 95 | 3 | 1.20 | 1.28 | 3 | |
| 7 | F-1 (5 gm/m$^2$) | II-10 (10 mg/m$^2$) | G-1 (100 mg/m$^2$) | I-1 | 100 | 4 | 1.10 | 1.20 | 4 | Invention |
| 8 | F-1 (5 mg/m$^2$) | II-10 (10 mg/m$^2$) | G-1 (100 mg/m$^2$) | I-6 | 102 | 4 | 1.13 | 1.22 | 4 | |
| 9 | F-1 (5 mg/m$^2$) | II-10 (10 mg/m$^2$) | G-1 (100 mg/m$^2$) | I-7 | 101 | 4 | 1.09 | 1.18 | 4 | |
| 10 | F-4 (5 mg/m$^2$) | II-10 (10 mg/m$^2$) | G-1 (100 mg/m$^2$) | I-1 | 102 | 4 | 1.10 | 1.21 | 4 | |
| 11 | F-7 (5 mg/m$^2$) | II-10 (10 mg/m$^2$) | G-1 (100 mg/m$^2$) | I-1 | 100 | 4 | 1.12 | 1.23 | 4 | |
| 12 | F-12 (5 mg/m$^2$) | II-10 (10 mg/m$^2$) | G-1 (100 mg/m$^2$) | I-1 | 99 | 5 | 1.12 | 1.22 | 4 | |
| 13 | F-4 (5 mg/m$^2$) | II-2 (10 mg/m$^2$) | G-1 (100 mg/m$^2$) | I-1 | 105 | 4 | 1.10 | 1.20 | 5 | |
| 14 | F-4 (5 mg/m$^2$) | II-5 (10 mg/m$^2$) | G-1 (100 mg/m$^2$) | I-1 | 101 | 4 | 1.15 | 1.24 | 5 | |
| 15 | F-4 (5 mg/m$^2$) | II-10 (10 mg/m$^2$) | G-4 (100 mg/m$^2$) | I-1 | 103 | 5 | 1.10 | 1.19 | 4 | |
| 16 | F-4 (5 mg/m$^2$) | II-10 (10 mg/m$^2$) | G-8 (100 mg/m$^2$) | I-1 | 100 | 4 | 1.08 | 1.20 | 4 | |
| 17 | F-4 (5 mg/m$^2$) | II-10 (10 mg/m$^2$) | G-2 (50 mg/m$^2$) | I-1 | 99 | 4 | 1.11 | 1.20 | 4 | |

As can be understood from the results in Table 1, the samples of the invention excel in each of sensitivity, gradation, and maximum density, while exhibiting good coloration.

The samples of the invention exhibited smaller change in characteristic values even when a developing temperature fluctuated, and these samples was less probe to processing-induced density irregularities.

| | | |
|---|---|---|
| Coloration | 5 | Extremely good |
| | 4 | Good |
| | 3 | Ordinary |
| | 2 | Poor |
| | 1 | Extremely poor |
| Processing-induced density irregularities | 5 | Extremely good |
| | 4 | Good |
| | 3 | Ordinary |
| | 2 | Poor |
| | 1 | Extremely poor |

EXAMPLE 2

Samples were prepared and their photographic performance was evaluated in a manner identical to that of Sample No. 7 of Example 1, except that Sensitizing Dye I-1 was replaced respectively with I-5, I-8, I-9, I-12, and I-14. And results similar to those of Sample No. 7 were obtained.

EXAMPLE 3

Samples were prepared and their photographic performance was evaluated in a manner identical to that of Sample No. 7 of Example 1, except that Fluorine-containing ionic Surfactant F-1 was replaced respectively with F-3, F-6, F-8, F-10, and F-21. And results similar to those of Sample No. 7 were obtained.

EXAMPLE 4

Samples were prepared and their photographic performance was evaluated in a manner identical to that of Sample No. 7 of Example 1, except that Nonionic Surfactant II-10 was replaced respectively with III-3, III-5, IV-9, and IV-11. And results similar to those of Sample No. 7 were obtained.

What is claimed is:

1. A silver halide light-sensitive photographic material for a laser light exposure, comprising:

a support having thereon at least one light-sensitive silver halide emulsion layer containing silver halide grains; and a layer adjacent to said at least one light-sensitive silver halide emulsion layer, wherein said silver halide grains are spectrally sensitized with a dye represented by formula I and at least one layer of said at least one silver halide emulsion layer and said adjacent layer contains a fluorine-containing ionic surfactant, a non-ionic surfactant and an inorganic salt, wherein said inorganic salt is a halide, a phosphate or a thyocyanate of alkali metal, alkali earth metal or ammonium;

wherein $Z_1$ and $Z_2$ independently represent an atomic group needed for completing a five- or six-membered nitrogen-containing heterocycle;

$R_1$ and $R_2$ independently represent a saturated or unsaturated aliphatic group;

$Q_1$ and $Q_2$ independently represent an atomic group needed for completing a 4-thiazolidinone, a 4-oxazolidinone, a 4-imidazolidinone, a 5-thiazolidinone, a 5-oxazolidinone or a 5-imidazolidinone ring;

$L_1$, $L_2$ and $L_3$ independently represent a methin group or a substituted methin group

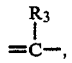

wherein $R_3$ represents a methyl group, an ethyl group, an ethoxy group or an aryl group;

X represents an inorganic or organic acid anion; and m and n independently represent an integer of 0 to 3.

2. The silver halide light-sensitive photographic material of claim 1, wherein said material contains a multivavalent alcohol which has at least two hydroxyl groups in the molecular structure and a melting point not less than 40° C.

3. The silver halide light-sensitive photographic material of claim 2, wherein the content of said multivalent alcohol is whithin the range of 5 to 10 g per mole of silver halide.

4. The silver halide light-sensitive photographic material of claim 1, wherein said material contains a condensation product of a compound represented by the formula V below and an aldehyde;

formula V

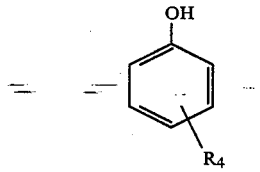

wherein $R_4$ represents a hydrogen atom, an alkyl group or a cycloalkyl group.

5. The silver halide light-sensitive photographic material of claim 4, wherein the content of said condensation product is whithin the range of 0.03 to 1.3 g per mole of silver halide.

6. The silver halide light-sensitive photographic material of claim 1, wherein the silver halide is a silver iodobromide.

7. The silver halide light-sensitive photographic material of claim 6, wherein said silver halide contains 0.5 to 10 mole % of silver iodide.

8. The silver halide light-sensitive photographic material of claim 1, wherein at least 80% of total number of silver halide grains present in said silver halide emulsion layer has a grain size whithin the range of 0.1 to 1.2 μm.

9. The silver halide light-sensitive photographic material of claim 1, wherein at least 80% of total number of silver halide grains present in said silver halide emulsion layer has a grain size whithin the range of 0.2 to 0.7 μm.

10. A method of exposing a silver halide light-sensitive photographic material, comprising a step of imagewise exposing with a laser light a silver halide light-sensitive material comprising:

a support having thereon at least one light-sensitive silver halide emulsion layer containing silver halide grains; and a layer adjacent to said at least one light sensitive silver halide emulsion layer, wherein said silver halide grains are spectrally sensitized with a dye represented by formula I and at least one layer of said at least one silver halide emulsion layer and said adjacent layer contains a fluorine-containing ionic surfactant, a non-ionic surfactant and an inorganic salt, wherein said inorganic salt is a halide, a phosphate or a thyocyanate of alkali metal, alkali earth metal or ammonium;

formula I

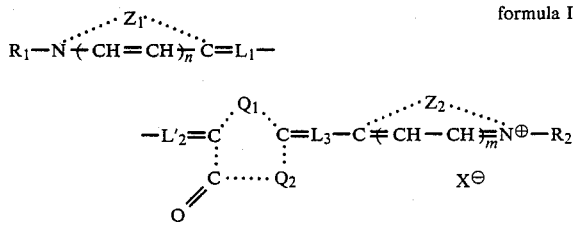

wherein $Z_1$ and $Z_2$ independently represent an atomic group needed for completing a five- or six-membered nitrogen-containing heterocycle;

$R_1$ and $R_2$ independently represent a saturated or unsaturated aliphatic group;

$Q_1$ and $Q_2$ independently represent an atomic group needed for completing a 4-thiazolidinone, a 4-oxazolidinone, a 4-imidazolidinone, a 5-thiazolidinone, a 5-oxazolidinone or a 5-imidazolidinone ring;

$L_1$, $L_2$ and $L_3$ independently represent a methin group or a substituted methin group

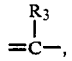

wherein $R_3$ represents a methyl group, an ethyl group, an ethoxy group or an aryl group;

X represents an inorganic or organic acid anion; and m and n independently represent an integer of 0 to 3.

* * * * *